US006072940A

United States Patent [19]

Doran

[11] Patent Number: 6,072,940

[45] Date of Patent: Jun. 6, 2000

[54] WALLPAPER REMOVER WITH SUCTION CUPS

[76] Inventor: Kevin George Doran, Basement Flat 9 Nightingale Road, Southsea, Portsmouth, PO5 3JH, United Kingdom

[21] Appl. No.: 09/061,211

[22] Filed: Apr. 16, 1998

[51] Int. Cl.[7] ..... A61H 33/06; A61H 33/12

[52] U.S. Cl. ..... 392/394; 392/404

[58] Field of Search ..... 392/386, 390, 392/400, 401, 402, 403, 404, 405, 406; 126/271.1; 122/DIG. 10

[56] References Cited

U.S. PATENT DOCUMENTS

| | | | |
|---|---|---|---|
| 1,674,237 | 6/1928 | Bauer | 392/405 |
| 2,998,924 | 9/1961 | Schaeffer | 392/405 |
| 3,997,459 | 12/1976 | Osrow et al. | 392/405 |
| 5,208,895 | 5/1993 | Hoover, Jr. et al. | 392/404 |

*Primary Examiner*—Sang Paik

[57] ABSTRACT

A wallpaper remover system is provided including a base and a steam applicator assembly mounted on the base for dispensing steam upon the receipt thereof. Also included is a plurality of suction cups coupled to the base for releasably securing the same to a recipient surface.

7 Claims, 2 Drawing Sheets

WALLPAPER REMOVER WITH SUCTION CUPS

BACKGROUND OF THE INVENTION

1. Field of the Invention

The present invention relates to wallpaper removing steamers and more particularly pertains to a new wallpaper remover with suction cups for facilitating the removal of wallpaper from a recipient surface.

2. Description of the Prior Art

The use of wallpaper removing steamers is known in the prior art. More specifically, wallpaper removing steamers heretofore devised and utilized are known to consist basically of familiar, expected and obvious structural configurations, notwithstanding the myriad of designs encompassed by the crowded prior art which have been developed for the fulfillment of countless objectives and requirements.

Known prior art wallpaper removing steamers include U. S. Pat. Nos. 4,855,568; 4,835,364; 5,447,597; 5,430,965; 5,277,389; and U.S. Pat. No. Des. 345,903.

In these respects, the wallpaper remover with suction cups according to the present invention substantially departs from the conventional concepts and designs of the prior art, and in so doing provides an apparatus primarily developed for the purpose of facilitating the removal of wallpaper from a recipient surface.

SUMMARY OF THE INVENTION

In view of the foregoing disadvantages inherent in the known types of wallpaper removing steamers now present in the prior art, the present invention provides a new wallpaper remover with suction cups construction wherein the same can be utilized for facilitating the removal of wallpaper from a recipient surface.

The general purpose of the present invention, which will be described subsequently in greater detail, is to provide a new wallpaper remover with suction cups apparatus and method which has many of the advantages of the wallpaper removing steamers mentioned heretofore and many novel features that result in a new wallpaper remover with suction cups which is not anticipated, rendered obvious, suggested, or even implied by any of the prior art wallpaper removing steamers, either alone or in any combination thereof.

To attain this, the present invention generally comprises a base having a planar rectangular plate and a rectangular peripheral lip integrally coupled to a periphery of the plate and extending therefrom. By this structure, an interior space and an open bottom of the base are defined. The peripheral lip is formed of a pair of elongated side faces and a pair of short end faces. The plate of the base has a linear handle coupled to a top surface thereof in parallel relationship with a central longitudinal bisector of the plate. The coupling of the handle on the base is preferably accomplished via a pair of stanchions mounted on ends of the handle. FIGS. 3 best shows a steam applicator assembly including a linear outlet pipe having ends coupled between centers of the end faces of the base. Similar to the handle, the outlet pipe remains in parallel relationship with the central longitudinal bisector of the plate. Further, the outlet pipe has a plurality of spaced, linearly aligned apertures formed therein along a length thereof for dispensing steam from the open bottom of the base upon the receipt thereof. The steam applicator assembly further includes a hose removably coupled to one of the ends of the outlet pipe. As shown in the Figures, the hose extends from one of the end faces of the base for connecting with a separate steam generator to supply the outlet pipe with steam. Finally, a suction cup assembly includes a plurality of suction cups each mounted to a bottom surface of the plate of the base adjacent to one of the corners thereof. Each of the suction cups is adapted to secure to a recipient surface upon the rotation of an associated lever in a predetermined direction. The suction cup assembly further includes an actuator arm hingably coupled at an inboard end thereof to an end of the handle of the base. The actuator arm is adapted to rotate the levers of each of the suction cups in the predetermined direction upon the depression thereof against the handle. By this structure, the actuator arm secures each of the suction cups to the recipient surface by way of a single action.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new wallpaper remover with suction cups apparatus and method which has many of the advantages of the wallpaper removing steamers mentioned heretofore and many novel features that result in a new wallpaper remover with suction cups which is not anticipated, rendered obvious, suggested, or even implied by any of the prior art wallpaper removing steamers, either alone or in any combination thereof.

It is another object of the present invention to provide a new wallpaper remover with suction cups which may be easily and efficiently manufactured and marketed.

It is a further object of the present invention to provide a new wallpaper remover with suction cups which is of a durable and reliable construction.

An even further object of the present invention is to provide a new wallpaper remover with suction cups which is susceptible of a low cost of manufacture with regard to both materials and labor, and which accordingly is then susceptible of low prices of sale to the consuming public, thereby making such wallpaper remover with suction cups economically available to the buying public.

Still yet another object of the present invention is to provide a new wallpaper remover with suction cups which provides in the apparatuses and methods of the prior art some of the advantages thereof, while simultaneously overcoming some of the disadvantages normally associated therewith.

Still another object of the present invention is to provide a new wallpaper remover with suction cups for facilitating the removal of wallpaper from a recipient surface.

Even still another object of the present invention is to provide a new wallpaper remover that includes a base and a steam applicator assembly mounted on the base for dispensing steam upon the receipt thereof. Also included is a plurality of suction cups coupled to the base for releasably securing the same to a recipient surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
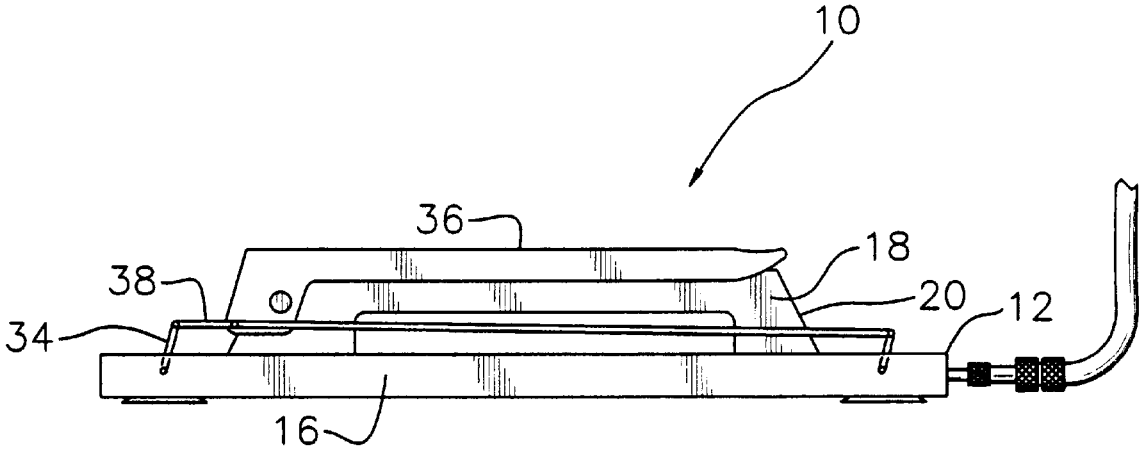
FIG. 1 is a side view of a new wallpaper remover with suction cups according to the present invention.

With reference now to the drawings, and in particular to FIGS. 1 through 4 thereof, a new wallpaper remover with suction cups embodying the principles and concepts of the present invention and generally designated by the reference numeral 10 will be described.

The present invention, designated as numeral 10, includes a base 12 having a planar rectangular plate 14 and a rectangular peripheral lip 16 integrally coupled to a periphery of the plate and extending therefrom. By this structure, an interior space and an open bottom of the base are defined. The peripheral lip is formed of a pair of elongated side faces and a pair of short end faces. The plate of the base also has a linear handle 18 coupled to a top surface thereof in parallel relationship with a central longitudinal bisector of the plate. For reasons that will soon become apparent, the handle preferably has a square cross-section along an entire length thereof. The coupling of the handle on to the base is preferably accomplished via a pair of stanchions 20 mounted on ends of the handle.

Figure 3:
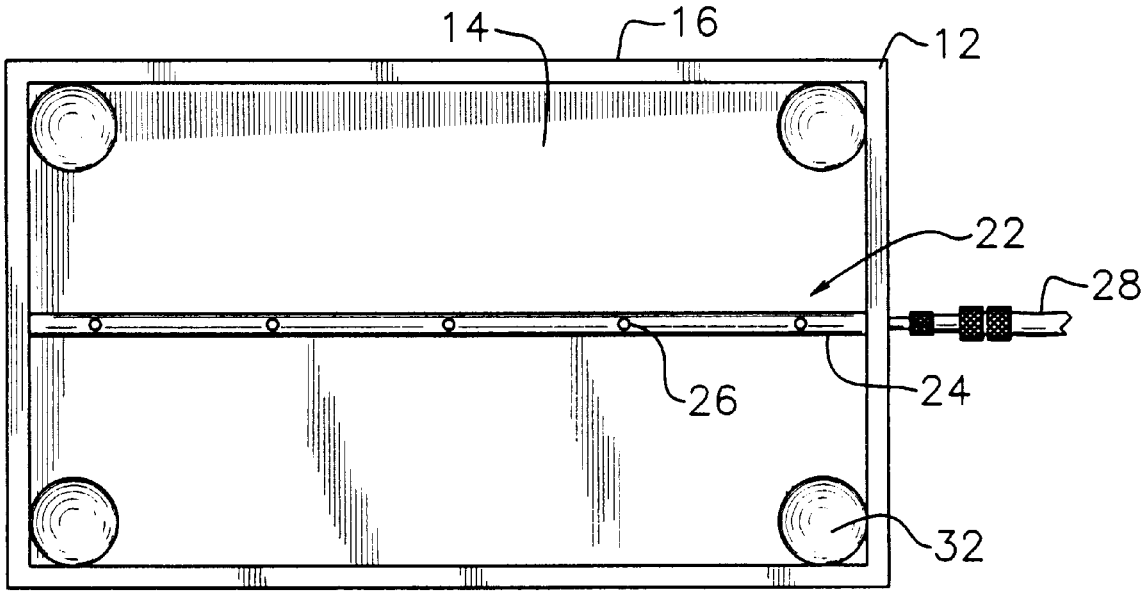
FIG. 3 is a bottom view of the present invention.

FIGS. 3 best shows a steam applicator assembly 22 including a linear outlet pipe 24 having ends coupled between centers of the end faces of the base. Similar to the handle, the outlet pipe remains in parallel relationship with the central longitudinal bisector of the plate. Further, the outlet pipe has a plurality of spaced, linearly aligned apertures 26 formed therein along a length thereof for dispensing steam from the open bottom of the base. The steam applicator assembly further includes a flexible hose 28 removably coupled to one of the ends of the outlet pipe by way of a threaded connector. As shown in the Figures, the hose extends from one of the end faces of the base for connecting with a separate steam generator in order to supply the outlet pipe with steam.

Finally, a suction cup assembly 30 includes a plurality of suction cups 32 each mounted to a bottom surface of the plate of the base adjacent to an associated one of its corners. Each of the suction cups is adapted to secure to a recipient surface upon the rotation of an associated lever 34 in a predetermined direction. As shown in the Figures, the levers each extend upwardly through an associated cut out formed in the base. It should be noted that such levers are commonly associated with suction cups that are used to secure to and lift large panes of glass. The suction cup assembly further includes an actuator arm 36 hingably coupled at an inboard end thereof to an end of the handle of the base.

In use, the actuator arm is adapted to rotate the levers of each of the suction cups in the predetermined direction upon the depression thereof against the handle. In such orientation, a square recess formed on an underside of the actuator arm is adapted to accept the shape of the handle. Note FIG. 1. By this structure, the actuator arm secures each of the suction cups to the recipient surface by way of a single action, thereby aiding in the removal of wallpaper on the recipient surface.

Figure 2:
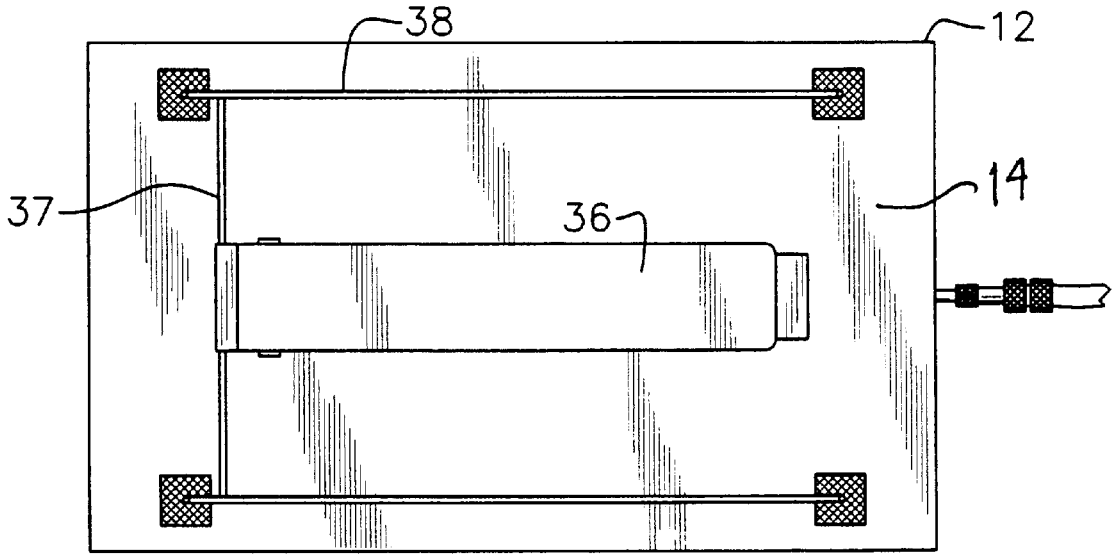
FIG. 2 is a top view of the present invention.
Figure 4:
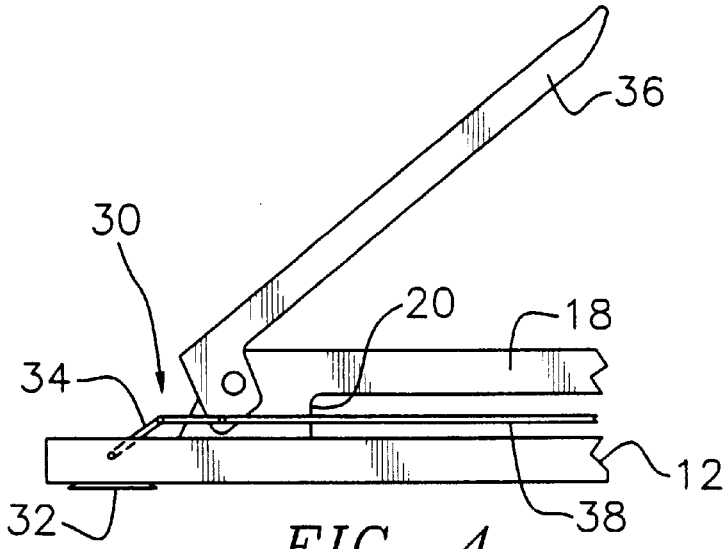
FIG. 4 is a side view of the present invention.

While the coincident rotation of the levers with the actuator arm may be accomplished in any one of various ways, a possible method is shown in FIGS. 1, 2 & 4. As shown in such Figures, a cross bar 37 is coupled at a central extent thereof to the actuator arm. Further, ends of the cross bar are rotatably coupled to a pair of side bars 38 which have ends rotatably coupled to the levers of the suction cups for rotating the same upon the raising and lowering of the actuator arm. It should be noted that the bars shown in the Figures may readily be situated within the base for concealment purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wallpaper remover with suction cups comprising, in combination:

a base including a planar rectangular plate and a rectangular peripheral lip integrally coupled to a periphery of the plate and extending therefrom for defining an interior space and an open bottom, the peripheral lip defined by a pair of elongated side faces and a pair of short end faces, the plate of the base having a linear handle coupled to a top surface thereof in parallel relationship with a central longitudinal bisector of the plate via a pair of stanchions mounted on ends thereof;

a steam applicator assembly including a linear outlet pipe having ends coupled between centers of the end faces of the base in parallel relationship with the central longitudinal bisector of the plate, the outlet pipe having a plurality of spaced, linearly aligned apertures formed therein along a length thereof for dispensing steam from the open bottom of the base upon the receipt thereof, the steam applicator assembly further including a hose removably coupled to one of the ends of the outlet pipe and extending from one of the end faces of the base for connecting with a separate steam generator for supplying the outlet pipe with steam; and a suction cup assembly including a plurality of suction cups each mounted to a bottom surface of the plate of the base adjacent to one of the corners thereof, each of the suction cups adapted to secure to a recipient surface upon the rotation of an associated lever in a predetermined direction, the suction cup assembly further including an actuator arm hingably coupled at an inboard end thereof to an end of the handle of the base, the actuator arm adapted to rotate the levers of each of the suction cups in the predetermined direction upon the depression thereof against the handle, thereby securing the base to the recipient surface.

2. A wallpaper remover system comprising:

a base;

a steam applicator assembly mounted on the base for dispensing steam upon the receipt thereof; and mounting means coupled to the base for releasably securing the base to a recipient surface.

3. The wallpaper remover system as set forth in claim 2 wherein the mounting means includes at least one suction cup.

4. The wallpaper remover system as set forth in claim 3 wherein the suction cup includes an associated lever for securing the suction cup to the recipient surface when rotated.

5. The wallpaper remover system as set forth in claim 4 wherein the mounting means includes a plurality of suction cups with levers which are adapted to be rotated coincidentally.

6. The wallpaper remover system as set forth in claim 5 wherein the levers are rotated via a single actuator arm.

7. The wallpaper remover system as set forth in claim 6 wherein the arm is pivotally mounted on a handle of the base.

* * * * *